United States Patent [19]

Cheng

[11] Patent Number: 5,059,961

[45] Date of Patent: Oct. 22, 1991

[54] SCREEN BLANKER FOR A MONITOR OF A COMPUTER SYSTEM

[76] Inventor: Te J. Cheng, 3rd Fl., 238 Chuang Ching Rd., Taipei, Taiwan

[21] Appl. No.: 397,059

[22] Filed: Aug. 21, 1989

[51] Int. Cl.[5] ..... G09G 3/02

[52] U.S. Cl. ..... 340/720; 340/811; 358/165

[58] Field of Search ..... 340/720, 811; 307/125, 307/126, 141, 141.4; 358/190, 220, 165; 371/16.3

[56] References Cited

U.S. PATENT DOCUMENTS

| | | | |
|---|---|---|---|
| 3,941,989 | 3/1976 | McLaughlin et al. | 340/811 X |
| 4,806,784 | 2/1989 | Goda | 340/811 X |
| 4,811,200 | 3/1989 | Wagner et al. | 364/200 |

FOREIGN PATENT DOCUMENTS

| | | | |
|---|---|---|---|
| 0154026 | 9/1983 | Japan | 371/16.3 |
| 0043008 | 2/1989 | Japan | 340/811 |

*Primary Examiner*—Ulysses Weldon

*Attorney, Agent, or Firm*—Andrus, Sceales, Starke & Sawall

[57] ABSTRACT

The present invention discloses a screen blanker for a monitor of a computer system, which will automatically clear the data image on the display screen of a monitor of a computer system after the computer has not been operated for a predetermined time period, and the data image which had disappeared will reappear once again on the display screen of the monitor after data is keyed in again by the operator. By this, the display screen of the monitor of the computer system can be protected from getting burned images thereon.

1 Claim, 2 Drawing Sheets

SCREEN BLANKER FOR A MONITOR OF A COMPUTER SYSTEM

BACKGROUND OF THE INVENTION

The present invention relates generally to a screen blanker for a monitor of a computer system, and particularly to a screen blanker for a monitor of a personnel computer display system such as VGA (video graphic array), EGA (enchanced graphic adapter), MGA (monochrome graphic adapter), and CGA (color graphic adapter). The system will automatically clear the data image on the display screen of a monitor of a computer system after the computer has not been operated for a predetermined time period, and the data image which had disappeared will reappear on the display screen after the data has been once again keyed in by the operator.

People use computers to process large volumes of information in a variety of ways, and nowadays personnel computers have become common to most households.

During operation, if the operator of a computer leaves his or her seat for a long time without turning off the monitor, the life of the monitor will decrease rapidly. To solve this problem, a sensor installed under the seat of the operator is used to check if the operator is sitting on the seat or not. If the operator is not sitting on the seat, the data image on the display screen of the monitor will be cleared automatically, and the data image which had disappeared will reappear on the display screen when the operator's return to his or her seat.

There are, however, some drawbacks in the above conventional system:

(1) cables are needed to connect the computer and the sensor, and it is a complex and time-consuming task to install a sensor under the seat;

(2) if the operator leaves his or her seat only for a short time (for example, only to fetch a glass of water), the data image on the display screen will be cleared and displayed again within a short time period, thus the life of the monitor will be greatly damaged.

SUMMARY OF THE INVENTION

The primary object of the present invention is to provide a screen blanker for a monitor of a computer system, which will automatically clear the data image on the display screen of a monitor of a computer system after the computer has not been operated for a predetermined time period, and the data image will reappear on the display screen of the monitor once data has been keyed in again by the operator.

According to the present invention, a screen blanker for a monitor of a computer system comprises a CPU;

a video RAM connected to the CPU;

a CRT controller connected to the CPU;

a screen blanker having a first input terminal, a second input terminal and a third input terminal, the first input terminal being connected between the CPU and the video RAM for receiving memory write/read signal coming from the video RAM, the second input terminal and third input terminal being connected to the CRT controller, for receiving respectively the horizontal synchronizing signal and the vertical synchronizing signal coming from the CRT controller; and a video monitor connected between the CRT controller and the screen blanker, having a first input terminal and a second input terminal for receiving a vertical signal and a horizontal signal coming from a first output terminal and a second output terminal of the screen blanker, respectively, characterized in that:

the screen blanker comprises:

a timer composed of a first counter, the second counter, a third counter and a fourth counter, a first input terminal of the first counter being connected to the output terminal of a first inverter, and the input terminal of the first inverter forming the third input terminal of the screen blanker for receiving a vertical synchronizing signal coming from the CRT controller, a first input terminal of the second counter being connected to the output terminal of a second inverter, and the input terminal of the second inverter forming the first input terminal of the screen blanker for receiving a memory write/read signal coming from the video RAM, the fourth counter being provided with a first output terminal, a second output terminal and a third output terminal;

a time selector capable of being connected to any one of the three output terminals of the fourth counter of the timer;

a detector connected between the time selector and the first input terminal of the second counter of the timer, the detector being composed of a third inverter, a fourth inverter and an RS flip-flop, the RS flip-flop being composed of a first NAND gate and a second NAND gate, the output terminal of the second NAND gate forming the output terminal of the detector; and a video signal controller connected between the output terminal of the detector and the third input terminal of the screen blanker, the video signal controller being composed of a third NAND gate, a fourth NAND gate, a fifth inverter and a sixth inverter, the fifth inverter and the sixth inverter being respectively connected in series with the third NAND gate and the fourth NAND gate, a first input terminal of the third NAND gate and a first input terminal of the fourth NAND gate being connected to the output terminal of the detector, a second input terminal of the third NAND gate being connected to the third input terminal of the screen blanker, a second input terminal of the fourth NAND gate being connected to the second input terminal of the screen blanker, the output terminals of the fifth inverter and the sixth inverter respectively forming the first and second output terminals of the screen blanker.

BRIEF DESCRIPTION OF THE DRAWINGS

The present invention can be more fully understood by reference to the following description and accompanying drawings, which form an integral part of this application.

DETAILED DESCRIPTION OF THE PREFERRED EMBODIMENTS

Figure 1:
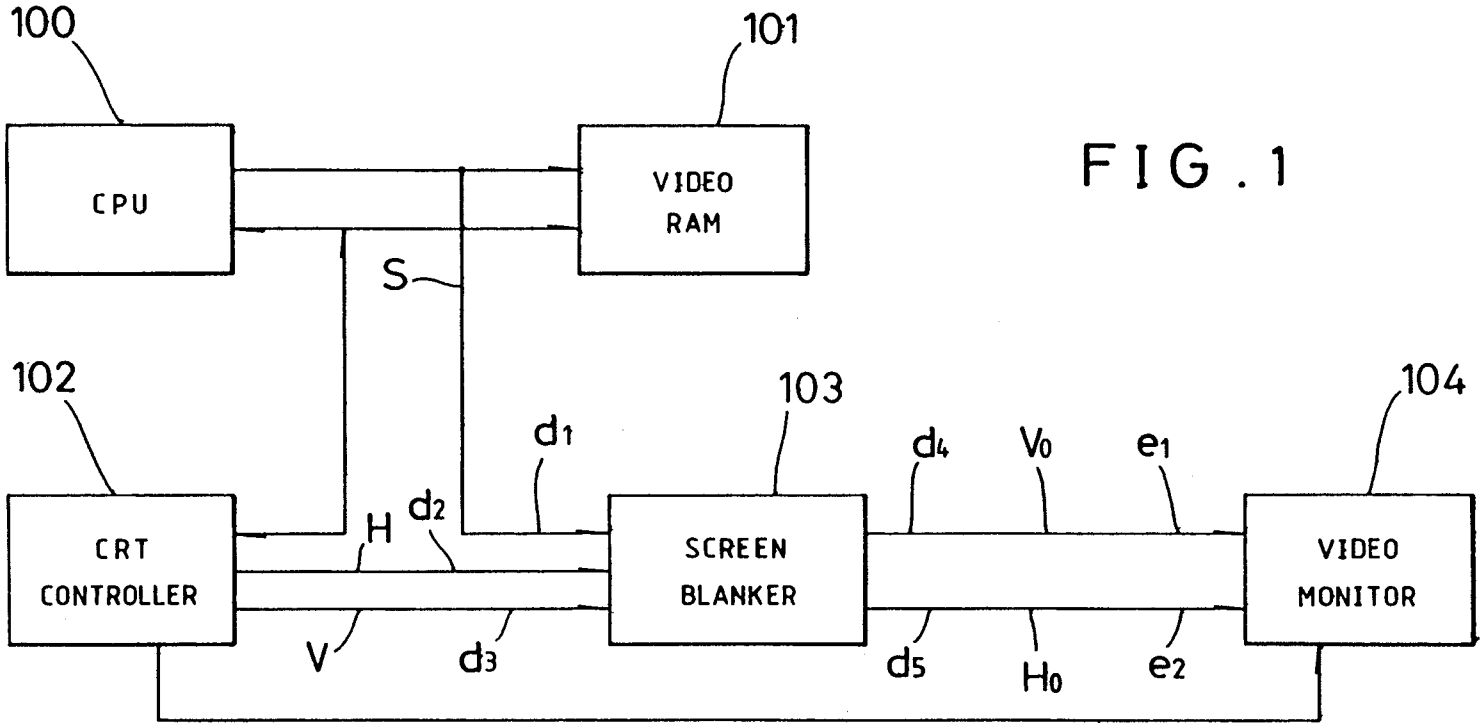
FIG. 1 is the block diagram showing the connection between an embodiment of this invention and a computer system.
Figure 2:
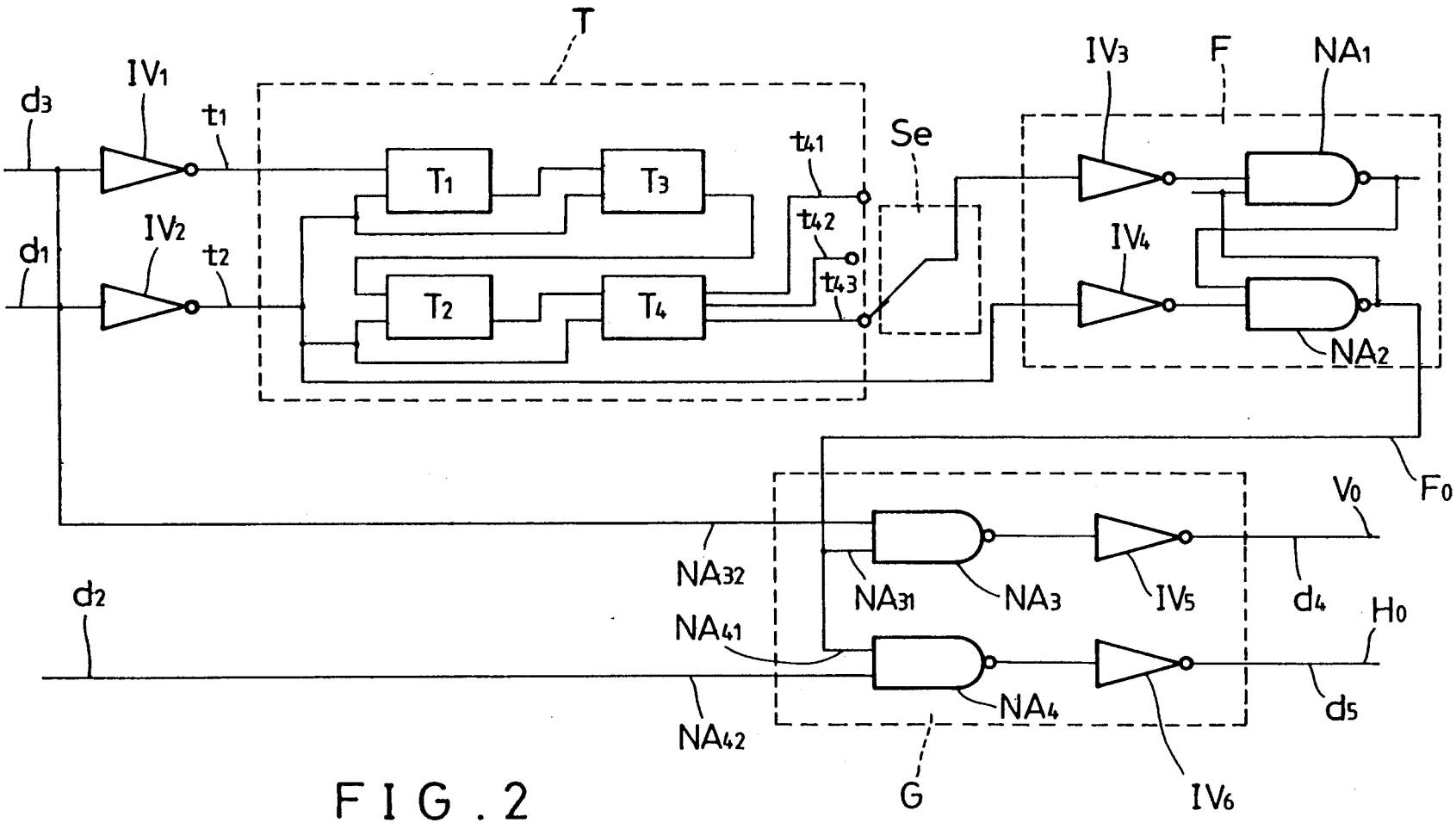
FIG. 2 is an electric circuit diagram of this invention.

As shown in FIG. 1 and FIG. 2, a computer system accommodated in this invention comprises: a CPU (Central Processing Unit) 100; a video RAM (video Random Acess Memory) 101 connected to the CPU 100; a CRT controller (Cathode Ray Tube controller) 102 connected to the CPU 100; and a screen blanker 103 having three input terminals d1, d2 and d3. The first input terminal d1 of screen blanker 103 is connected between the CPU 100 and the video RAM 101 for receiving memory write/read signal S coming from the video RAM 101, and the second input terminal d2 and third input terminal d3 are connected to the CRT controller 102, for respectively receiving the horizontal synchronizing signal H and the vertical synchronizing signal V coming from the CRT controller 102. In video monitor 104 is connected between the CRT controller 102 and the screen blanker 103 and has a first input terminal e1 and second input terminal e2 for receiving vertical signal Vo and horizontal signal Ho coming from the first output terminal d4 and the second output terminal d5 respectively.

The screen blanker 103 of this embodiment includes a timer T, a time selector Se, a detector F and a video signal controller G. The timer T comprises four counters T1, T2, T3 and T4 (see FIG. 2). The input terminal t1 of the first counter T1 is connected to a first inverter IV1, and the input terminal of the first inverter IV1 forms the third input terminal d3 of the screen blanker 103 for receiving the vertical synchronizing signal V coming from the CRT controller 102. The input terminal t2 of the second counter T2 is connected to a second inverter IV2, and the input terminal of the second inverter IV2 forms the first input terminal d1 of the screen blanker 103 for receiving the memory write/read signal S coming from the video RAM 101. The fourth counter T4 is provided with three terminals t41, t42 and t43. After data has been keyed in, the memory write/read signal S coming from the video RAM 101 will change from high level signal "1" to low level signal "0" showing that the video RAM 101 is receiving data coming from the CPU 100 and is changing its content. At the same time, a high level signal "1" is entered into the input terminal t2 of the second counter T2 of the timer T. Thus, all four counters are reset and begin to recount. On the other hand, if no data is keyed in (for example, when the operator leaves his or her seat), at various instants of two minutes and thirty seconds, five minutes, and ten minutes after counting begins, the output terminals t41, t42 and t43 will in turn output one signal.

The time selector Se is capable of being connected to any one of the three output terminals t41, t42 and t43 of the fourth counter T4 of the timer T.

The detector F is connected between the time selector Se and the input terminal t2 of the second counter T2 of the timer T. The detector F comprises a third inverter IV3, a fourth inverter IV4 and an RS flip-flop (see FIG. 2). The RS flip-flop is composed of a first NAND gate NA1 and a second NAND gate NA2. The output terminal of the second NAND gate NA2 forms the output terminal Fo of the detector F.

The video signal controller G is connected between the output terminal Fo of the detector F and the third input terminal d3 of the screen blanker 103. The video signal controller G is composed of a third NAND gate NA3, a fourth NAND gate NA4, a fifth inverter IV5 and a sixth inverter IV6. The fifth inverter IV5 and the sixth inverter IV6 are series connected respectively with the third NAND gate NA3 and the fourth NAND gate NA4. The first input terminals NA31 and NA41 of the third NAND gate NA3 and the fourth NAND gate NA4 are connected to the output terminal Fo of the detector F, and the second input terminal NA32 of the third NAND gate NA3 is connected to the third input terminal d3 of the screen blanker 103. The second input terminal NA42 of the fourth NAND gate NA4 is connected to the second input terminal d2 of the screen blanker 103. The output terminals of fifth inverter IV5 and the sixth inverter IV6 form, respectively, the first and second output terminals d4 and d5 of the screen blanker 103.

The four counters T1 to T4 of the timer T of this embodiment are I.C.'s with model No. 74LS393, and the six inverters IV1 to IV6 are I.C.'s with model No. 74LS04. The four NAND gates NA1 to NA4 are I.C.'s with model No. 74LS00.

During operation of the aforementioned computer system, if no data is keyed in, the memory write/read signal S maintains at the state of high level "1", and a high level signal "1" is entered into the input terminals d1, d2 and d3 of the screen blanker 103, thus the counters T1 to T4 of the timer T will begin to count. At various instants of two minutes and thirty seconds, five minutes, and ten minutes after counting begins, the output terminals t41, t42 and t43 will in turn output one signal. If the time selector Se is connected to the third output terminal t43 of the fourth counter T4, the detector F will be activated after ten minutes have elapsed from the beginning of the counting, and the output terminal Fo of the detector F will output a low level signal "0" so as to turn off the video signal controller G. Thus, horizontal synchronizing signal H and vertical synchronizing signal V coming from the CRT controller 102 can not be entered into the video monitor 104, and the data image on the display screen will disappear (although the video RAM 101 will still contain the data). When the operator again keys in data, the memory write/read signal S changes from high level signal "1" to low level signal "0", and a high level signal "1" will be entered into the input terminal t2 of the second counter T2 of the timer T. Thus, the four counter T1 to T4 will be reset, and the three output terminals t41 to t43 of the fourth counter T4 will output low level signal "0". Consequently, the output terminal Fo of the detector F will output a high level signal "1", and thus the video signal controller G is turned on, and horizontal synchronizing signal H and vertical synchronizing signal V coming from the CRT controller 102 will be entered into the video monitor 104 by way of the video signal controller G, and the data image which had disappeared will reappear on the display screen.

It should be noted that the time period elapsed before data image on the display screen disappears can be determined optionally by selecting a time period of two minutes and thirty seconds, five minutes or ten minutes.

While the invention has been described in terms of what is presently considered to be the most practical and preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A screen blanker for a video monitor of a computer system having a CPU, a video RAM connected to said CPU, and a CRT controller connected to said CPU, said video monitor being connected to said CRT controller and said screen blanker, said video monitor having a first input terminal and a second input terminal for receiving a vertical synchronizing signal and horizontal synchronizing signal respectively, said screen blanker comprising:

a first input terminal, a second input terminal and a third input terminal, said first input terminal being connectable between said CPU and said video RAM for receiving a memory write/read signal from said video RAM, said second input terminal and third input terminal being connectable to said CRT controller, for respectively receiving the horizontal synchronizing signal and the vertical synchronizing signal from said CRT controller;

a first output terminal and a second output terminal for providing said vertical synchronizing signal and horizontal synchronizing signal, respectively, to said first and second input terminals of said video monitor;

a timer comprising a first counter, a second counter, a third counter and a fourth counter, said counters being interconnected to provide timing intervals, a first input terminal of said first counter being connected to an output terminal of a first inverter, and an input terminal of said first inverter forming said third input terminal of said screen blanker for receiving the vertical synchronizing signal from said CRT controller, a first input terminal of said second counter being connected to an output terminal of a second inverter, and an input terminal of said second inverter forming said first input terminal of said screen blanker for receiving the memory write/read signal from said video RAM, said fourth counter being provided with a first output terminal, a second output terminal and a third output terminal;

a time selector capable of being connected to a desired one of said first, second, or third output terminals of said fourth counter of said timer;

a detector connected between said time selector and said first input terminal of said second counter of said timer, said detector comprising a third inverter, a fourth inverter and an RS flip-flop, said RS flip-flop being comprised of a first NAND gate and a second NAND gate, an output terminal of the second NAND gate forming an output terminal of said detector; and a video signal controller connected to said output terminal of said detector and said third input terminal of said screen blanker, said video signal controller comprising a third NAND gate, a fourth NAND gate, a fifth inverter and a sixth inverter, said fifth inverter and said sixth inverter being respectively connected in series with said third NAND gate and said fourth NAND gate, a first input terminal of said third NAND gate and a first input terminal of said fourth NAND gate being connected to said output terminal of said detector, a second input terminal of said third NAND gate being connected to said third input terminal of said screen blanker, a second input terminal of said fourth NAND gate being connected to said second input terminal of said screen blanker, the output terminals of said fifth inverter and said sixth inverter forming, respectively, said first and second output terminals of said screen blanker.

* * * * *